US005263751A

United States Patent [19]

Priest et al.

[11] Patent Number: 5,263,751

[45] Date of Patent: Nov. 23, 1993

[54] DOOR LATCH ACTUATOR

[75] Inventors: William L. Priest, Sterling Heights; Michael E. Aubry, Shelby Township, Macomb County, both of Mich.

[73] Assignee: General Motors Corporation, Detroit, Mich.

[21] Appl. No.: 975,345

[22] Filed: Nov. 16, 1992

[51] Int. Cl.[5] ..... E05C 3/26

[52] U.S. Cl. ..... 292/336.3; 292/252; 292/201; 292/DIG. 27

[58] Field of Search ..... 292/216, 252, 201, 280, 292/336.3, DIG. 27

[56] References Cited

U.S. PATENT DOCUMENTS

| | | | |
|---|---|---|---|
| 3,679,251 | 7/1972 | Brockman et al. | 292/DIG. 27 X |
| 3,753,316 | 8/1973 | Savarieau et al. | 292/201 X |
| 4,073,527 | 2/1978 | Schlage | 292/DIG. 27 X |
| 5,098,141 | 3/1992 | Bull | 292/252 |

*Primary Examiner*—Richard E. Moore

*Attorney, Agent, or Firm*—Charles E. Leahy

[57] ABSTRACT

An electromechanical actuator for an automotive door latch has a selectively activated feature that prevents a rear door from being unlatched by the inside door handle. The feature is electrically activated by a switch or the like that is conveniently located near the driver and out-of -reach of the rear seat passengers.

4 Claims, 1 Drawing Sheet

DOOR LATCH ACTUATOR

BACKGROUND OF THE INVENTION

This invention relates to automotive door latches and more particularly to an actuator for an automotive door latch that has a selectively activated feature that prevents the door from being unlatched by the inside door handle.

Automotive door latches are typically unlatched from inside the passenger compartment by an inside door handle that is mechanically connected to the door latch by a linkage system that operates an unlatching lever in the door latch in response to operation of the inside door handle.

The door latch also typically include a lock mechanism that prevents the door from being unlatched by either the inside or the outside door handle.

Automatic door latches and door latch systems that have child security features are also known. When activated, the child security feature prevents the door from being unlatched by the inside door handle even if the lock mechanism is not engaged. The control for activating these known child security features is located on the door associated with the latch or the latch itself. Consequently selected activation of the child security feature is not easily accomplished under all circumstances.

SUMMARY OF THE INVENTION

The object of this invention is to provide an actuator for operating a door latch that can be selectively activated to disable an inside door handle easily under all circumstances.

A feature of the invention is that the actuator can be selectively activated f rom a location remote from the automobile door that has its inside door handle disabled by the actuator.

Another feature of the invention is that the actuator may be activated electromagnetically so that it can be remotely controlled easily.

Still yet another feature of the invention is that the actuator can be used for a rear automobile door and activated by a switch or the like that is under the control of the driver.

Still another feature of the invention is that the actuator can be used for a rear automobile door and activated by a switch or control that is out-of-reach of the rear seat passengers but yet is easy to operate.

Still yet another feature of the invention is that the actuator is activated to a disabling mode so that actuator failure does not disable the door handle.

BRIEF DESCRIPTION OF THE DRAWINGS

The above and other objects, features and advantages of the invention will become more apparent from the following description taken in conjunction with the accompanying drawings wherein like references refer to like parts and wherein.

DESCRIPTION OF THE INVENTION

Figure 1:
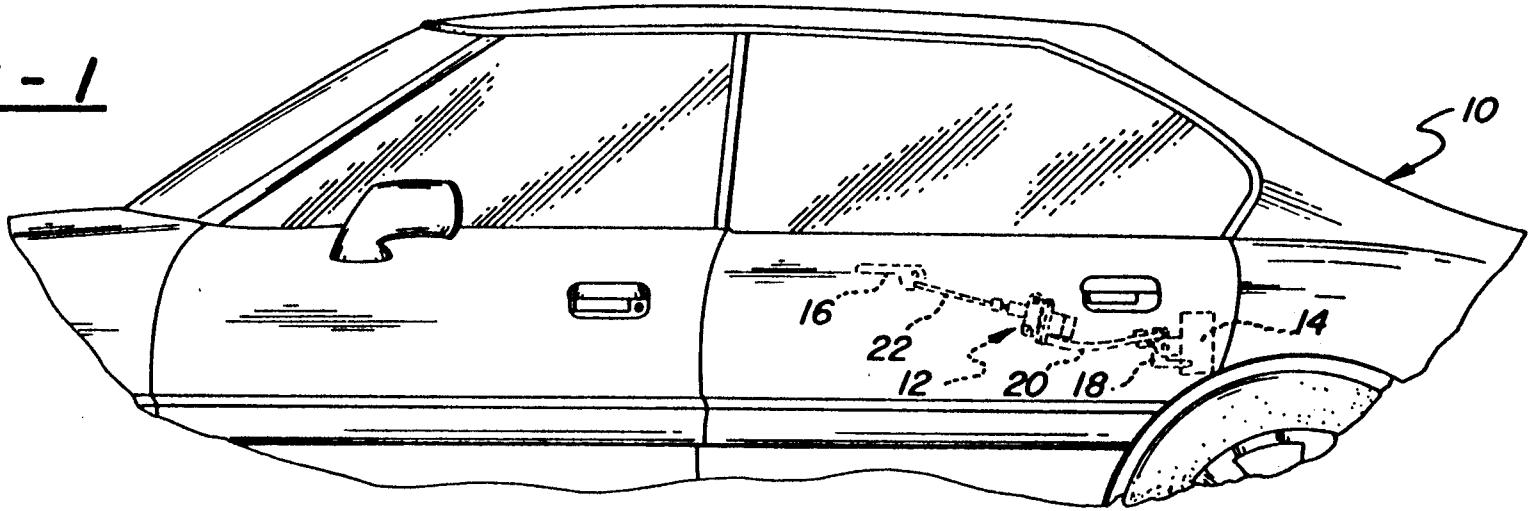
FIG. 1 is a fragmentary side view of an automobile that is equipped with an actuator in accordance with the invention.

Referring now to the drawing, FIG. 1 shows a four door automobile 10 that has an actuator indicated generally at 12 mounted in the rear door for operating a rear door latch 14 by means of a remote inside door handle 16 that is mounted on the inside of the rear door.

The rear door latch 14 may be of any suitable type. By way of example, a suitable door latch is disclosed in U.S. Pat. No. 4,575,563 granted to Stephen K. Garwood and Jeffrey L. Konchan Jul. 12, 1988 which is hereby incorporated in this patent specification by reference. This patented door latch has an operating lever that unlatches a fork bolt when the operating lever is pivoted counter-clockwise and the latch is-not locked. The patented door latch is shown schematically at 14 in FIG. 1 with the operating lever indicated at 18.

The operating lever 18 is connected to the actuator 12 by a push-pull cable assembly 20 and the actuator 12 in turn is connected to the inside door handle 16 by a pull rod 22. During normal operation, the actuator 12 acts as a solid link between the cable of the push-pull cable 20 and the pull rod 22 so that the inside door handle 16 unlatches the door latch 14 when the inside door handle 16 is rotated counterclockwise from the position shown in FIG. 1. However, when the actuator 12 is in a disabling mode, the actuator 12 disconnects an internal linkage so that it does not transfer the motion of the pull rod 22 to the cable of the push-pull cable assembly 20.

Figure 2:
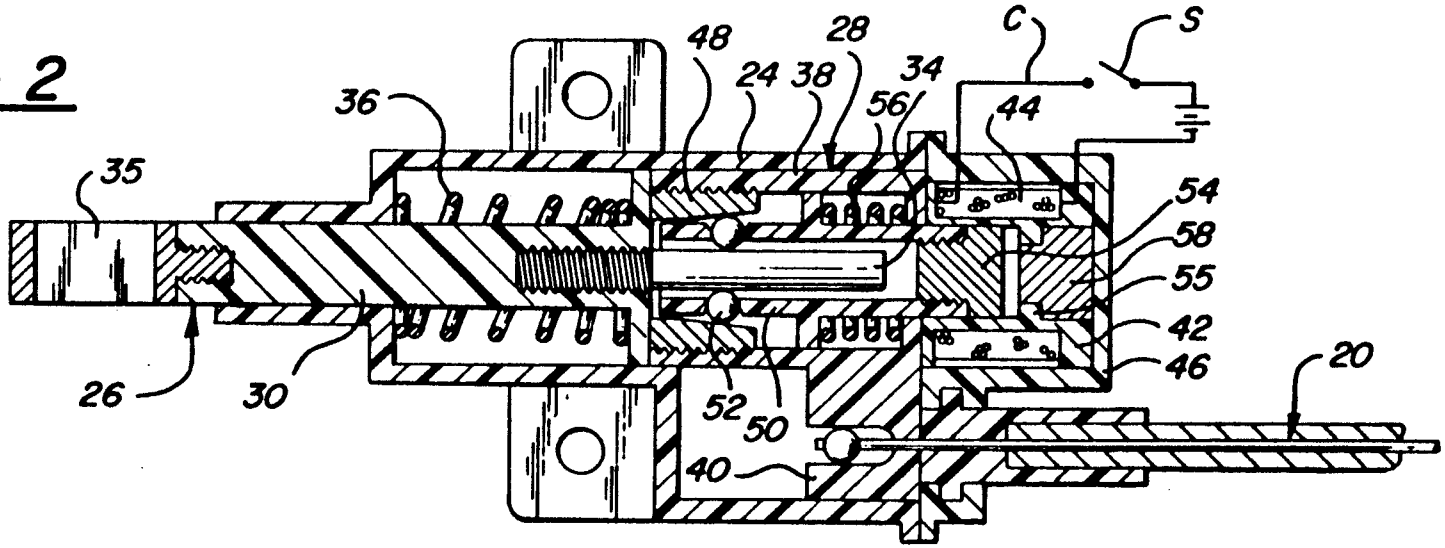
FIG. 2 is a longitudinal sectional, partially schematic view of the actuator that is shown in FIG. 1.

Referring now to FIG. 2, the actuator 12 comprises a housing 24 made of nylon or other suitable material that has apertured flanges or other suitable means for fastening the housing 24 to an inner shell of the rear door. An input member 26 and an output member 28 are slideably mounted in the housing 24 for translation on a common longitudinal axis.

The input member 26 includes a nylon plunger 30 having a flange 32 at an inner end. A metal shaft 34 is secured to the inner end of the plunger 30 in cantilever fashion so that it projects into the output member 28. The outer end of the plunger 30 has a metal yoke 35 that connects the input member 26 to the pull rod 22. The input member 26 is biased to a retracted position shown in FIG. 2 by a coil spring 36 that surrounds the plunger 30 inside the housing 24 and pushes the flange 32 against the end of the output member 28.

The output member 28 comprises a hollow piston 38 that slides in the housing 24 and an offset boss 40 that connects the cable of the push pull cable assembly 20 to the output member 28. The hollow piston 38 is held against the end of a nylon bobbin 42 f or an electric coil 44 by the coil spring 36 for retracting the plunger 30. The bobbin 42 is housed in a nylon end cap 46 that is attached to an end of the housing 24. The end cap 46 also secures one end of the sheath of the push pull assembly 20.

The output member 28 also includes an annular wedge 48 is screwed or otherwise suitably secured in the inner end of the hollow piston 38 so that it surrounds the shaft 34 of the input member 26 that projects into the hollow piston 38.

The actuator 12 has a hollow plunger 50 that slides inside the hollow piston 38. One end of the hollow plunger 50 is located in an annular space between the annular wedge 48 and the shaft 34. This end of the hollow plunger 50 has a plurality of circumferentially spaced pockets that carry hard steel drive balls 52. The drive balls 52 are wedged between the annular wedge 48 and the shaft 34 when the hollow plunger 50 is spring biased in the engaged position that is shown in FIG. 2.

A metal insert 54 is screwed or otherwise suitably secured in the other end of the hollow plunger 50. The metal insert 54 retracts or pulls the hollow plunger 50 to the right from the engaged position shown in FIG. 2 to a disengaged position where it engages a stop shoulder 55 in the bobbin 44 when an electromagnet inside the end cap 46 is energized.

The actuator 12 includes a second lighter coil spring 56 that is located inside the hollow piston 38. The coil spring 56 engages a flange of the hollow plunger 50 and biases the hollow plunger 50 toward the input member 26, that is toward the left as viewed in FIG. 2, so that the drive balls 52 are biased into wedging engagement with the annular wedge 48 and the shaft 34.

The actuator 12 further includes an electromagnet comprising the electric coil 44 that is wound on the bobbin 42 and a core 58 of iron or other magnetizable material that is secured in the bore of the bobbin 42 behind the stop shoulder 55.

The actuator 12 operates in the following manner. During normal operation, the coil 44 is deenergized and the internal parts of the actuator 12 are located in the respective positions shown in FIG. 2. In this condition, the rear door of the automobile can be unlatched by pulling the inside door handle 16 up so that it rotates clockwise. This translates the pull rod 22 and the input member 26 to the left as viewed in FIGS. 1 and 2. The translating input member 26 in turn pulls the output member 28 to the left through the action of the drive balls 52 that are continuously biased into wedging engagement with the annular wedge 48 and the shaft 34 by the coil spring 56. The output member 28 in turn pulls the cable of the push pull cable assembly 20 to the left which rotates the operating lever 18 of the door latch 14 counterclockwise to unlatch the rear door. When the rear door is unlatched and opened, the operating lever 18 is returned to its original position by an internal spring in the door latch 14. The input and output members 26 and 28 in turn are -returned to their original positions by the coil spring 36.

The actuator 12 is placed in the disabling mode by selective activation of the disabling feature. For instance, the coil 44 may be energized by closing a switch S or the like in an electrical power circuit C that is shown schematically in FIG. 2. The switch S or other suitable control for activating the child safety feature may be conveniently located near the driver where it is located out-of-reach of the rear seat passengers.

When the coil 44 is energized the hollow plunger 50 is retracted, that is moved toward the right from the position shown in FIG. 2, against the bias of the lighter coil spring 56 until it abuts the stop shoulder 55. This retraction pulls the drive balls 52 back out of wedging engagement with the annular wedge 48 and the shaft 34.

In this condition, the rear door cannot be unlatched by pulling the inside door handle 16 up. The inside door handle 16 still translates the pull rod 22 and the input member 26 to the left as viewed in FIGS. 1 and 2. However, the shaft 34 of the input member 26 cannot pull the output member 28 to the left through the action of the drive balls 52 because the hollow plunger 50 has pulled the drive balls 52 back toward the coil 44 to a disengaged or nonwedging position with respect to the annular wedge 48 and the shaft 34. The shaft 34 simply slides on the drive balls 52 which are now free to rotate in their pockets and consequently there is not any motion imparted to the output member 28.

The actuator 12 is returned to the normal operating mode by deactivating the disabling feature, that is simply by opening the switch S and deenergizing the coil 44 so that the hollow plunger 50 and the drive balls 52 are returned to the engaged position under the bias of the spring 56.

It is to be noted that the disabling feature of the actuator 12 is automatically deactivated if electrical power is lost due to the presence of the spring 56. This is a fail safe feature.

The invention has been described in an illustrative manner, and it is to be understood that the terminology which has been used is intended to be in the nature of words of description rather than of limitation.

Obviously, many modifications and variations of the present invention in light of the above teachings may be made. It is, therefore, to be understood that, within the scope of the appended claims, the invention may be practiced otherwise than as specifically described.

The embodiments of the invention in which an exclusive property or privilege is claimed are defined as follows:

1. An electromagnetic actuator for operating a door latch by an inside door handle comprising:

a housing that is adapted to be fastened to a automobile door, an input member and an output member that are slideably mounted in the housing for translation on a common longitudinal axis, the input member including a plunger having a flange at an inner end, a metal shaft that is secured to the inner end of the plunger in cantilever fashion so that it projects into the output member and a metal yoke that is attached to an outer end of the plunger f or connecting the input member to a pull rod that is operated by an inside door handle, the input member being biased to a retracted position by a coil spring inside the housing that engages the flange and pushes the input member against an inner end of the output member, the output member including a hollow piston that slides in the housing and an offset boss for connecting the output member to a cable of a push pull cable assembly that operates a door latch for the automobile door, the hollow piston being held against the end of an electric coil that is housed in an end cap that is attached to an end of the housing and that also secures one end of the sheath of the push pull cable assembly, the output member further including an annular wedge secured in an inner end of the hollow piston so that it surrounds the shaft of the input member, a hollow plunger that slides inside the hollow piston and that has one end that is located in an annular space between the annular wedge and the shaft the one end of the hollow plunger having a plurality of circumferentially spaced pockets that carry drive balls that are wedged between the annular wedge and the shaft when the hollow plunger is biased toward the input member and into an engaged position by a second lighter coil spring located inside the hollow piston, an electromagnet including the coil and a core of magnetizable material that is disposed inside the coil at one end, a metal insert secured in an opposite end of the hollow plunger for pulling the hollow plunger toward the electric coil and the drive balls out of wedging engagement against the bias of the second coil spring when the electromagnet is energized, and an electrical power circuit for energizing the coil that includes a switch or other suitable control.

2. An electromagnetic actuator for operating a door latch by an inside door handle comprising:

a housing that is adapted to be fastened to a automobile door, an input member and an output member that are slideably mounted in the housing for translation on a common longitudinal axis, the input member including a plunger having a flange, a shaft that projects into the output member and a yoke f or connecting the input member to a pull rod that is operated by an inside door handle, the input member being biased to a retracted position by a spring that pushes the flange toward the output member, the output member including a hollow piston that slides in the housing and a boss for connecting the output member to a cable of a push pull cable assembly that operates a door latch for the door, the output member further including an annular wedge secured in an inner end of the hollow piston so that the shaft of the input member extends through the annular wedge, a plunger that slides inside the hollow piston and that has a hollow end that is located in an annular space between the annular wedge and the shaft, the hollow end of the plunger having a plurality of circumferentially spaced pockets that carry drive balls that are wedged between the annular wedge and the shaft when the plunger is biased toward the input member and into an engaged position by a second spring, an electromagnet disposed inside the housing at an opposite end of the hollow plunger for pulling the hollow plunger away from the input member against the bias of the second spring when the electromagnet is energized, and an electrical power circuit for energizing the electromagnet that includes a switch or other suitable control.

3. An electromagnetic actuator for operating a door latch by an inside door handle comprising:

a housing that is adapted to be fastened to a automobile door, an input member and an output member that are slideably mounted in the housing for translation on a common longitudinal axis, the input member including a shaft and means for connecting the input member to a pull rod that is operated by an inside door handle, means for biasing the input member to a retracted position toward the output member, the output member including an annular wedge surrounding the shaft of the input member and means for connecting the output member to a cable of a push pull cable assembly that operates a door latch for the door, a plunger that slides inside the housing and that has an annular end that is located in an annular space between the annular wedge and the shaft, the annular end of the plunger having a plurality of circumferentially spaced pockets that carry drive balls, second means f or biasing the plunger toward the input member so that drive balls are wedged between the annular wedge and the shaft, and an electromagnet disposed inside the housing at an opposite end of the plunger for pulling the plunger away from the input member against the bias of the second means when the electromagnet is energized.

4. An actuator for operating a door latch by an inside door handle comprising:

a housing that is adapted to be fastened to a automobile door, an input member and an output member that are slideably mounted in the housing for translation on a common longitudinal axis, the input member including a shaft and means for connecting the input member to a pull means that is operated by an inside door handle, means for biasing the input member to a retracted position toward the output means, the output member including an annular wedge surrounding the shaft of the input member and means for connecting the output member to a pull means that operates a door latch for the door, a plunger that slides inside the housing and that has an annular end that is located in an annular space between the annular wedge and the shaft, the annular end of the plunger having a plurality of circumferentially spaced pockets that carry drive balls, second means for biasing the plunger toward the input member so that drive balls are wedged between the annular wedge and the shaft, and selectively activated means for pulling the plunger away from the input member against the bias of the second means so that the motion of the input member is not imparted to the output member via the drive balls.

* * * * *